United States Patent [19]

Hardy, Jr.

[11] Patent Number: 4,519,426

[45] Date of Patent: May 28, 1985

[54] APPARATUS FOR FILLING A LINED, SEMIBULK CONTAINER

[76] Inventor: Donald P. Hardy, Jr., 152 Parkway Ave., Lake Zurich, Ill. 60047

[21] Appl. No.: 560,609

[22] Filed: Dec. 12, 1983

[51] Int. Cl.[3] ..... B65B 1/04

[52] U.S. Cl. ..... 141/5; 141/114; 248/101

[58] Field of Search ..... 141/4, 5, 7, 10, 37, 141/75, 114, 198, 265, 269, 314; 248/99, 101

[56] References Cited

U.S. PATENT DOCUMENTS

| | | | |
|---|---|---|---|
| 2,703,671 | 3/1955 | Kindseth | 141/114 X |
| 3,572,401 | 3/1971 | Nelson et al. | 53/385 X |
| 4,182,386 | 1/1980 | Alack | 141/83 |
| 4,457,456 | 7/1984 | Derby et al. | 141/114 X |

FOREIGN PATENT DOCUMENTS

| | | | |
|---|---|---|---|
| 2090575 | 7/1982 | United Kingdom | 141/10 |

*Primary Examiner*—Stephen Marcus
*Assistant Examiner*—Mark John Thronson
*Attorney, Agent, or Firm*—Kinzer, Plyer, Dorn & McEachran

[57] ABSTRACT

Apparatus to fill any lined semibulk bag-like container, and through mechanical functions, to remove any twists or creases which could hamper the loading or unloading process. During filling, the apparatus will automatically separate the liner from the bag, except for the bottom section which is tied. The liner is then inflated to remove any twists after which product flow is activated at a trickle rate. After an automatically sensor-controlled amount of product has flowed into the inner liner at the trickle rate, the liner is lowered to full load position and the product flow is automatically activated to full flow at a greater rate. When a second set point is reached, the trickle rate is automatically activated again to top off the container to the predetermined amount of product, after which the unit turns off for container removal.

9 Claims, 2 Drawing Figures

APPARATUS FOR FILLING A LINED, SEMIBULK CONTAINER

This invention relates to apparatus and method for adding bulk material to a bag characterized by an outer bag of heavy construction such as woven, laminated polypropylene and an inner, more flexible liner, say a double ply of polyethylene.

BACKGROUND AND OBJECTS

The existing technique in the present state of the art is to feed products into large, lined semibulk containers while the liner rests in the container. Such dispensing, while simple, frequently fails to fill the container completely, and often causes folds and creases in the liner, which hamper loading and unloading of the container, in addition to causing spoilage and loss of both bags and product. The object of the present invention is to eliminate these existing problems.

Another object of the invention is to enable the filled bag readily to be removed by a forklift from the frame where the bag is suspended during the filling sequence.

Another object of the invention is to provide for an automated loading (bag filling) sequence.

IN THE DRAWING

FIG. 1 is a side view of the apparatus with the clamp open and nose cone down; and FIG. 2 is a side view, 90° from FIG. 1, with the clamp closed and the nose cone elevated to stretch the inner liner of the bag, ready for inflation.

DETAILED DESCRIPTION

Figure 1:
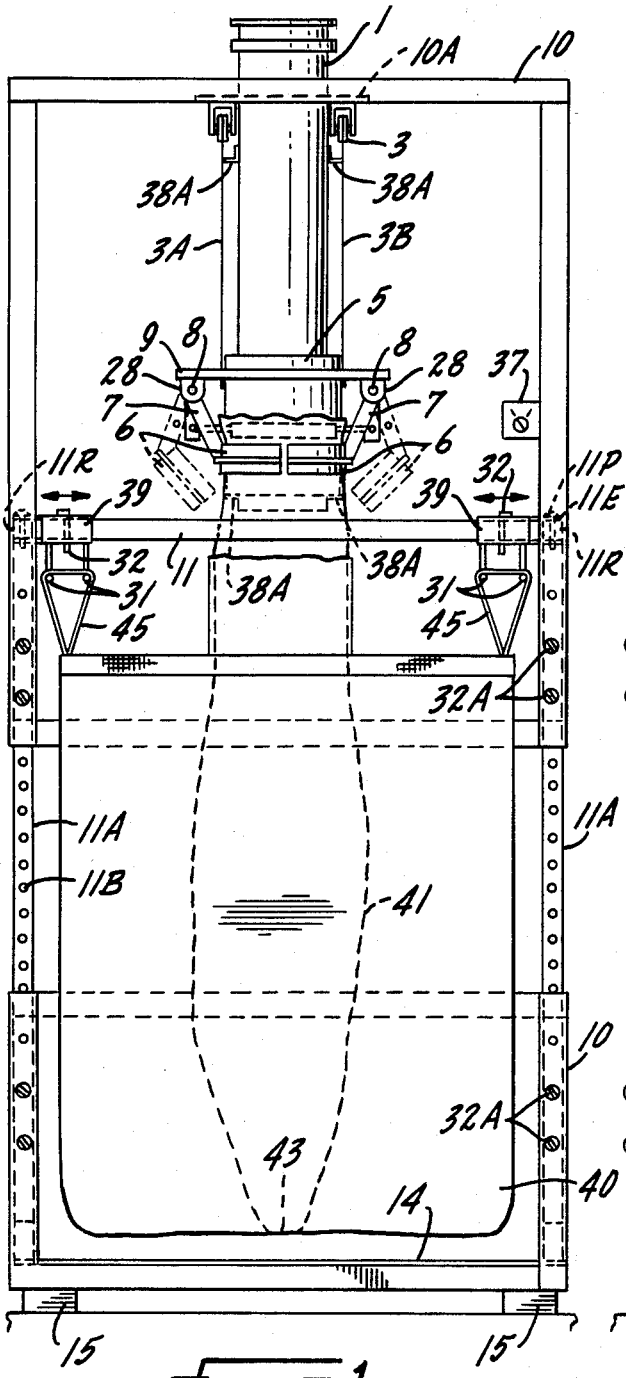

The following describes the form and operation of the apparatus.

Main load chute 1 is welded in a vertical position to a mounting plate 10A, that is bolted to the top of the main support structure (frame) 10.

A combination positive and negative air line 36 is welded to an aperture opening into the main load chute 1 and the air line extends down inside the chute. The positive air line is controlled by a valve 35. The negative air line is controlled by a valve 34.

Loading through the main load chute 1, flow is controlled by an air-activated butterfly valve assembly 17,18 including the valve 19 per se.

Figure 2:
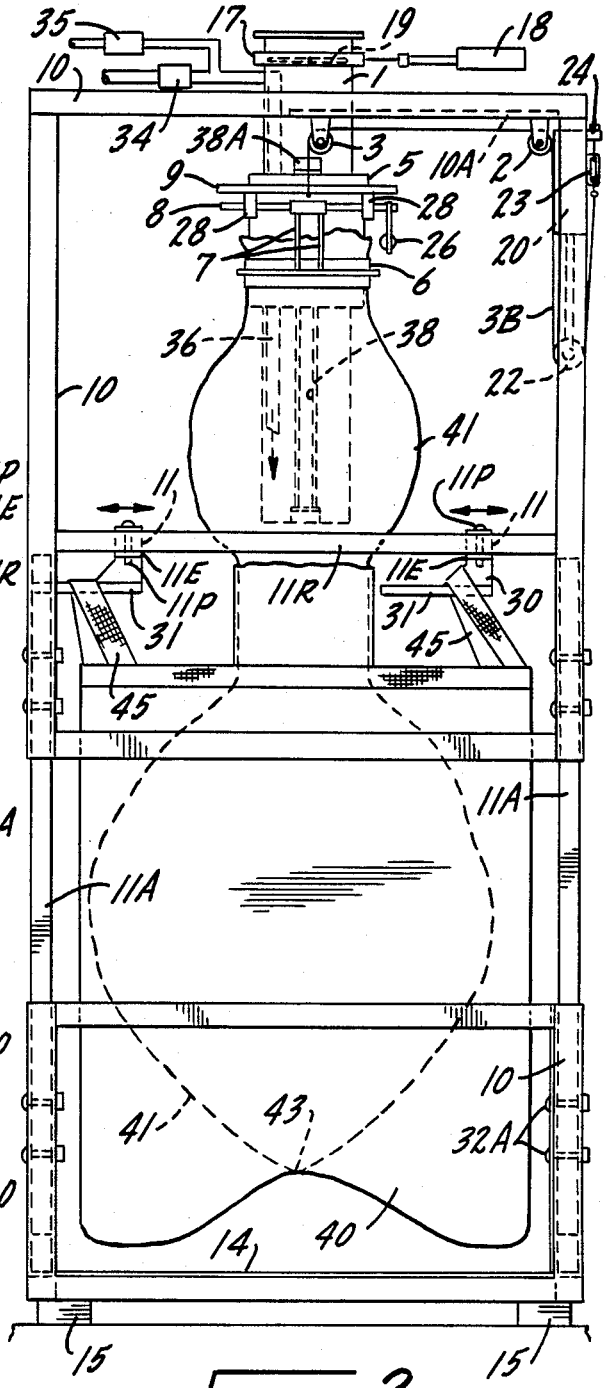

The main load chute 1 is surrounded by an air-activated sliding nose cone 5 actuated by a double-acting air cylinder 20, FIG. 2. Between the air cylinder 20 and the nose cone 5 there is a dual cable sling including a pair of cables 3A and 3B running over pulley assemblies 2, 3 and 22. The cables are connected at one end to a flange 9 on the nose cone and at the opposite end are connected to an adjustable coupling 23 which connects to the frame 10 using a connection block 24.

The cables may be actuated, either extended or slackened, by an air cylinder 20 as will be described.

Embracing the nose cone in a displaceable complemental fit are a pair of semicircular clamps or collars 6, each carried by an arm 7. Each arm 7 is secured at its upper end on a rock shaft 8 supported for rotation in pillow blocks 28 in turn supported by flange 9 welded to the nose cone. The clamps are opened and closed by an air cylinder 26.

The nose cone 5 has eight casters (not shown) inside of the cone which ride in tracks 38, FIG. 2, on the main load chute 1. There are stoppers as 38A at the top and bottom of tracks 38 limiting movement of the nose cone in each direction.

The apparatus has a fully adjustable frame and bag support system as follows:

The bag supports allowing split fork assemblies to be used are 30, 31 and 39, four sets. 39 is a short slide tube, presenting a pin hole for receiving an adjusting pin 32; this slide is able to slide on the cross brace support tube 11 which is apertured for the adjusting pin 32.

A pair of laterally projecting strap support rods 31 are welded to a bracket 30, welded to the related slide tube 39. The slide tubes 39 may be positioned laterally and held by pins 32 for bags of different size.

The support tubes 11 are also adjustable laterally for bags of different size. Thus, the ends of the tubes 11 have apertured ears 11E welded thereto, projecting outward, FIG. 1, and these slide on an apertured cross bar 11R, the adjusted position being held by a pin 11P.

The frame structure includes uprights 11A which are also apertured at 11B. By telescoping the uprights 11A into the vertical tubes 10 to complete the framework, and by providing apertures in selected of the tubes 10 to mate with the apertures 11B additional pins 32A may be used to adjust the frame vertically for bags of different size.

A bottom support plate 14 is welded to the bottom of the frame which assures a flat bottom bag during and after filling.

There is a weighing system which consists of four floor-supported load cells 15 connected to a control panel (not shown).

The bulk-bag comprises an outer bag 40 of sturdy construction and an inner more flexible liner 41, such as the construction noted above. Each has an open mouth at the top and the two are connected at the bottom only, 43. Four loop straps 45 of strong webbing are sewn to the outer bag and can be easily looped over the four sets of support fingers or bars 31. It can be seen that forklift forks can be easily entered into the loop straps when hung on the supports 31.

The air cylinder 20 which raises and lowers the nose cone is secured and centered at one side of the machine frame so its piston can be extended (down) or withdrawn (up) on a vertical axis. A horizontal arm (not shown) is secured to the free end of the piston and this arm carries a pulley 22 at each end. The cables 3A and 3B are played around these pulleys before being connected to their couplers 23.

Operation (1) The machine in FIG. 2 is at full rest position. Switch the system to "Power On" position (on panel not shown).

(2) Turn the remote station switch 37 (FIG. 1) to "Clamp Open" position. This actuates a double-acting air cylinder 26 and related piston supported between and linked to the cranks 7 depending from the rock shaft 8, opening the clamps 6.

(3) Place the bulk bag onto the frame by hooking the support straps 45 of the bag to the bag support assemblies on the machine. The bag should hang about two inches off of the base 14. Pull the neck of the liner 41 through the the top of the bag 40 and slide the neck of the liner up inside of the clamping assembly 6 which has been opened.

(4) Turn the remote station switch 37 to "Clamp Closed" position. This activates the air cylinder 26 which is gauged to slowly close the clamp, giving the operator ample time to remove his hands from the clamp area. The inner liner is soon clamped firmly to the nose cone.

(5) Press the "Auto Tare" button (on the control panel not shown). This automatically deducts or makes allowance for the weight of the machine, bag and liner.

(6) Press the "Auto Load" button (on the control panel not shown). This starts the fully automated load cycle, which is as follows:

The cylinder 20 is actuated to draw the cables 3A and 3B up and the nose cone is raised by the cables to lift the container to its preload position. The outer bag will usually be about two inches above support 14; the inner liner a little more. The raised liner will pull the bottom sections of the liner and bag tight where they are fastened together (FIG. 2).

As the nose cone reaches preload position a limit switch (not shown) is activated sending a signal to start the timed air inflation period. The positive air line valve 35 opens and the negative line valve closes. Air under pressure is admitted to inflate the liner 41 as seen in FIG. 2. This removes folds and wrinkles so there can be effective filling.

When the inflation cycle is timed as complete, a signal is generated which activates the butterfly valve 17–18 to one-quarter open piston ("trickle" load) on the main load chute and the positive air valve closes.

The same signal that starts the air inflation cycle starts a timer to delay the dedust control valve from opening until the flow has been established. This avoids a vacuum in the liner. The dedust (negative air) valve 34 stays activated (open) until the system goes to full rest position (off). This is a health feature to avoid ambient dust.

The four load cells mounted between the frame and the floor measure the preload flow into the liner in pounds. When the system reaches the first predetermined (preloaded) set point (in pounds) the nose cone air cylinder 20 is reversed and returns the nose cone toward home or full-load position. The butterfly valve is turned to full open position for bulk loading and as the bag fills it stretches to rest on the support plate 14 so there will be a flat bottomed bag when full.

When the weighing system reaches the second predetermined set point (in pounds) signifying a nearly full load in the bag a signal is generated to close the butterfly valve to its one-fourth open position, reestablishing the controlled trickle rate to ensure close accuracy in final filling.

When the third predetermined set point (in pounds) is reached the system returns to "Rest" position. This restores the sliding nose in a down position and the negative air valve and butterfly valve are closed as seen in FIG. 2.

(7) Turn the remote station switch to "Clamp Open" position, which opens the clamping assembly 6–9 to release the liner so it can be tied off.

(8) The full bag can now be removed with a fork truck by driving the forks through the openings in the straps, lifting the forks to the split fork assemblies so the bag assembly may now be supported on the forks. The truck is backed out slowly and transports the bag to the distribution point. This arrangement eliminates the need for pallets.

I claim:

1. Apparatus for filling a bulk-bag in which there is an outer bag and inner liner each with an open mouth at the top, which includes a filling chute supported by a main frame and a cone slidably mounted on the chute, said apparatus further including support elements on the frame enabling the outer bag to be suspended thereby so the bag and liner may be positioned with their open tops aligned to the chute and its cone, a clamp that can be opened and closed, said clamp having a complemental fit to the outside of the cone and means to close the clamp after extending the open top of the liner to fit the outside of the cone, means for sliding the cone upward on the chute after the mouth of the liner has been so clamped, thereby to support the liner independently of the outer bag, and means for supplying air under pressure to the interior of the liner after it has been independently supported as aforesaid so that the liner may be inflated sufficiently to remove wrinkles prior to adding bulk material to the independently supported liner.

2. Apparatus according to claim 1 in which the means for sliding the cone includes an air cylinder operatively connected thereto.

3. Apparatus according to claim 1 in which the support elements and frame are adjustable for bags of different size.

4. Apparatus according to claim 1 in which the support elements are four in number spaced and related to receive loop straps secured to the outer bag and to so stretch the straps that forklifts may be entered therein to capture and remove the bulk-bag when filled.

5. Apparatus according to claim 4 in which the support elements are spaced and related to receive loop straps secured to the outer bag and to so stretch the straps that forklifts may be entered therein to capture and remove the bulk-bag when filled.

6. A method for facilitating loading of bulk material in a bag assembly which comprises an outer bag of sturdy material and an inner liner each having an open mouth at the upper end, in that folds and creases in the inner liner are removed prior to adding bulk material and comprising the following steps:

A. clamping the open upper end of the liner to a cone slidably mounted on a filling chute to suspend the clamped liner by the cone independently of the outer bag while supporting the open end of outer bag independently of the liner so clamped;

B. raising the cone on the chute to partly separate the liner and bag;

C. inflating the liner with air while the liner is so suspended thereby to remove wrinkles and folds in the liner;

D. adding part of the bulk load to the liner while so suspended and after inflation;

E. restoring the cone after completing the partial load so that the outer bag and liner may be supported at the bottom, and then adding the full load of the bulk material.

7. A method according to claim 6 in which the partial load is fed at a slow rate and in which the full load for the most part is fed at a rapid rate followed by termination feed at a slow rate.

8. A method according to claim 6 in which the outer bag has four loop straps, and including the step of suspending the outer bag by those straps in such a way that liftforks may be entered therein to transport the filled bag assembly.

9. A method according to claim 7 in which the outer bag has four loop straps, and including the step of suspending the outer bag by those straps in such a way that liftforks may be entered therein to transport the filled bag assembly.

* * * * *